United States Patent [19]

Mosciatti et al.

[11] Patent Number: 4,828,406

[45] Date of Patent: May 9, 1989

[54] PORTABLE TICKET ISSUING DEVICE

[75] Inventors: Roger Mosciatti, Coram; Thomas P. Foley, Stonybrook; Frederick Moritz, Hauppauge; Jack Burge, East Northport, all of N.Y.

[73] Assignee: Citisource Inc., Rochelle Park, N.J.

[21] Appl. No.: 886,516

[22] Filed: Jul. 16, 1986

[51] Int. Cl.[4] ..... B41J 3/28; B41J 11/38

[52] U.S. Cl. ..... 400/23; 400/88; 400/48; 346/104; 101/69

[58] Field of Search ..... 101/69, 70; 400/88, 400/185, 23, 48, 624, 625, 629, 121, 124, 628; 206/39, 39.4, 39.5, 39.6; 221/2, 185, 268, 270; 346/129, 14 MR, 104, 134

[56] References Cited

U.S. PATENT DOCUMENTS

| | | | |
|---|---|---|---|
| 2,649,193 | 8/1953 | Condon | 206/39 |
| 3,302,774 | 2/1967 | Zalkind | 206/39 |
| 3,708,790 | 1/1973 | Nourigat | 346/134 X |
| 3,849,783 | 11/1974 | Tringali | 346/134 |
| 3,910,473 | 10/1975 | Colon | 346/104 X |
| 3,932,730 | 1/1976 | Ambrosio | 346/14 MR X |
| 3,986,594 | 10/1976 | Kondur | 400/124 X |
| 4,143,382 | 3/1979 | Brill | 400/88 X |
| 4,433,925 | 2/1984 | Fujiwara | 400/88 |
| 4,609,295 | 9/1986 | Shimodaira | 400/624 |

FOREIGN PATENT DOCUMENTS

| | | | |
|---|---|---|---|
| 749936 | 6/1956 | United Kingdom | 400/628 |

*Primary Examiner*—Paul T. Sewell

*Attorney, Agent, or Firm*—Abelman Frayne Rezac & Schwab

[57] ABSTRACT

A portable device for storing information as well as printing and dispensing multiple part tickets, such as traffic or parking violations tickets, includes a manually operable arrangement, for selecting and feeding a ticket from a stacked source of ticket stock, thus significantly reducing the energy requirements for operability and permitting portable usage of the device.

9 Claims, 9 Drawing Sheets

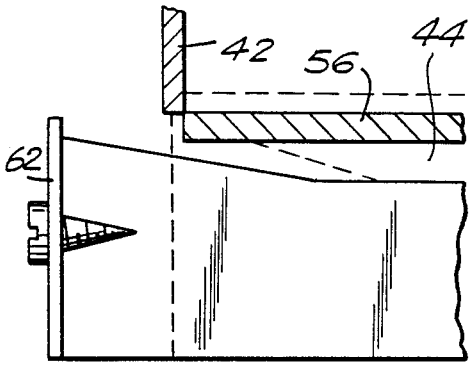
FIG. 5
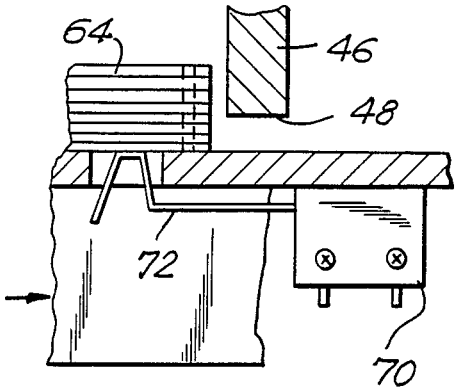
FIG. 6
FIG. 7A
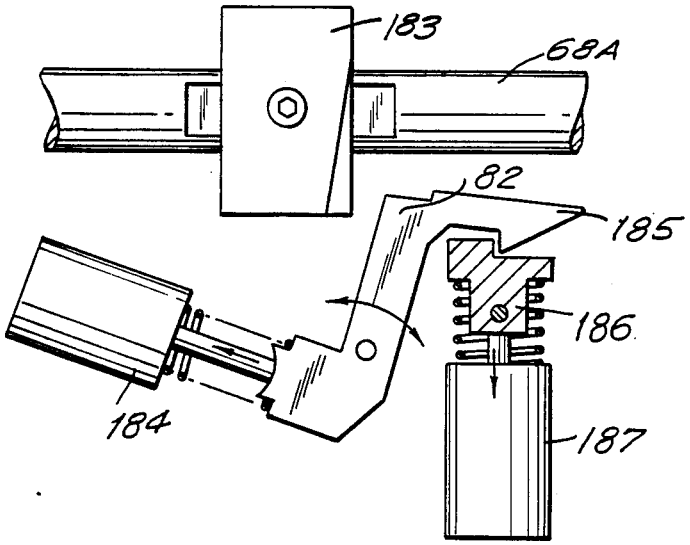

FIG. 9
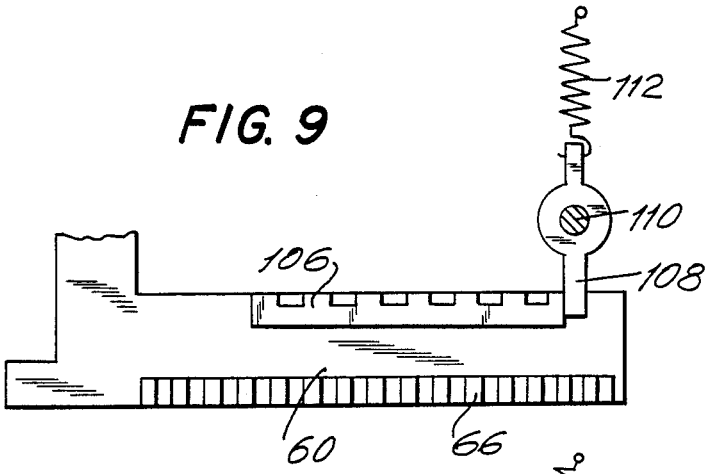
FIG. 10
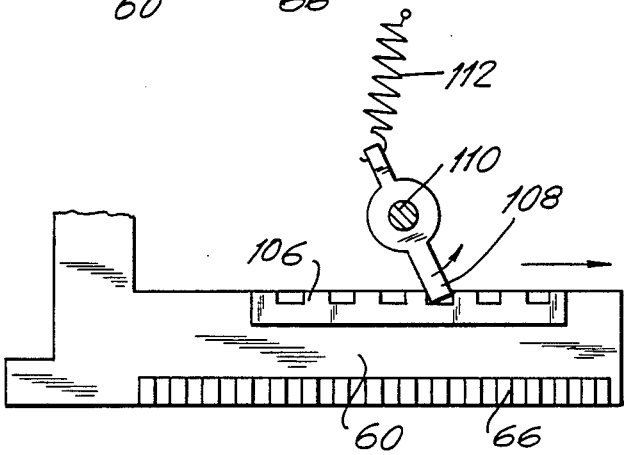
FIG. 11
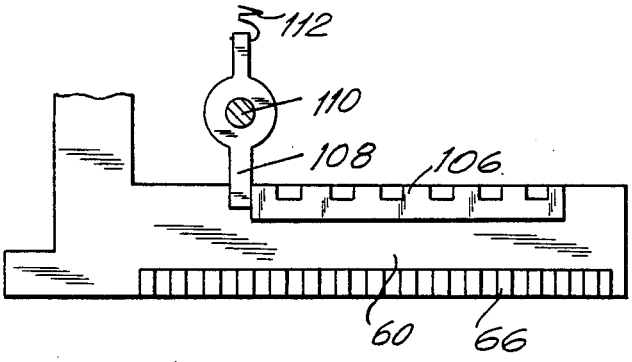
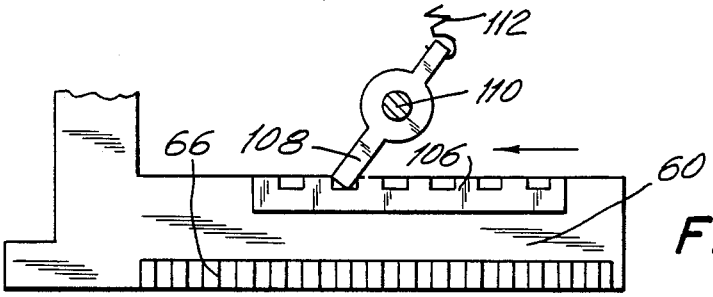
FIG. 12

PORTABLE TICKET ISSUING DEVICE

FIELD OF THE INVENTION

This invention relates to a self-contained portable device for use in storing, printing and dispensing of interleaved tickets.

BACKGROUND OF THE INVENTION

Numerous mechanisms are well known for storing information and also for storing, printing and dispensing data. Such mechanisms commonly employ a central processing unit or CPU with a peripheral device for printing and dispensing data. For the most part such mechanisms, due to their weight, size and energy consumption are relegated to stationary applications in proximity to a convenient source of power.

The operation of such ticket printing and dispensing devices under the control of a microprocessor controlled by an operator actuated keyboard is well-known in the art. A typical example of such a device is a microprocessor controlled cash register, as used in retail stores for the printing of sales tickets. Apart from requiring an external power source, and, being cumbersome, of large size and heavy weight, such devices are usually relegated either to the printing of sales receipts on a roll of paper in ribbon form, or, if interleaved sales tickets are employed, require the device prior to the printing of the ticket, usually with the requirement for manual withdrawal of the ticket after details of the transaction have been printed thereon.

Portable mechanisms also are well known, such as battery powered miniaturized electrically driven calculating machines, which include an electrically driven feed for a ribbon of paper tape, and, an electrically driven pin-block type printing head which is electrically powered and operated under the control of a microprocessor. While these mechanisms can be employed at locations remote from a fixed energy source, they can only be so employed for limited periods of time without replacement of the self contained energy source, owing to the rather heavy drain imposed on the self contained energy source in the actuation of the feeding and printing mechanisms.

Invariably, portable battery powered devices are relegated to relatively light usage for relatively short periods of time, and, to situations in which recharging or replacement of the energy source is readily available. As a consequence, such devices are usually confined to interior use, and do not lend themselves readily to use in the open, particularly in adverse weather conditions.

Portable devices are also well known which include a microprocessor controlled by an operator actuated keyboard, and which are capable of storing information fed into the microprocessor. A typical example of such a device is a hand held computer having an output terminal by means of which information stored within the microprocessor can be transferred to some other device, such as a computer or printer.

While such devices are well known in their separate specific applications, the combination of the respective mechanical and electrical functions into an integrated portable device has heretofore been considered as being either impractical due to the excessive power consumption and the rapid depletion of the energy source, or, due to the excessive size and weight thereof.

The major problem confronting such electrically powered portable devices, is the requirement for frequent recharging or replacement of the energy source, which commonly is in the form of a rechargeable battery pack comprised of nickel-cadmium cells, and the loss of stored data if the power is lost or significantly reduced prior to recharging.

It has also been recognized that if an electrically powered device could be made available having minimal power consumption, then, many long felt needs could be satisfied.

One particularly advantageous use of such a device is in the control of ticketing of illegally parked vehicles. Parking violations are usually issued by municipal employees who first identify a vehicle, and, if their suspicions are aroused, then telephone a central office for information as to the possibility of the vehicle having been stolen; and then, where appropriate, to manually write out a parking violation ticket.

This practice is time consuming, and has proven to be dangerous to the employee. Regrettably it is quite common for the employee to be verbally and physically threatened, and often physically abused while writing out the ticket. The on-the-job injury rate for compliance personnel is one of the highest among municipal emplyees.

One manner of overcoming these problems is to lessen the time required for the identification and ticketing process, by providing the employee with a portable unit which provides information as to stolen vehicles, and which also provides a means to readily and correctly issue a violations ticket.

This presents many problems, not the least of which is the nature and format of the tickets, which, almost universally are forms consisting of multiple part sets of carbonless stock. These are difficult to deliver in sequence due to their bulk, dimensions, and surface characteristics. Thus, to date, tickets are written by hand from a prenumbered inventory provided each officer. This method is not only inefficient, it is costly both in time taken and lost revenues. It is estimated that tens of millions of dollars are lost annually because handwritten tickets are illegible, or are incomplete, with the consequence that an accused violator cannot be located and the stipulated fine collected from the violator.

Further, strict control over the number of tickets distributed becomes difficult since all tickets must be accounted for by manual accounting and visual inspection.

While it has previously been recognized that a portable automated system would be beneficial in overcoming these problesm the requirements of portability, information storage, multiple functionality, and particularly the delivery and printing of multiple set ticket forms over the standard eight hour work shift were heretofore considered impossible.

A principle problem resides in the amount of electrical energy required to operate known mechanisms, and in the provisions of an adequate portable supply of electrical energy. The batteries required are of such bulk and weight as to negate the concept of portability. The energy required merely to deliver the ticket stock to the printing head poses sufficient energy consumption as to render such a system unsuited to its intended purpose.

The present invention solves these problems and provides a device which not only has applicability in the issuing of parking ticket violations, but also has appliability in any use where selected information is to be stored, recalled, and to which can be added new information recorded either in permanently printed form or in memory or both.

Exmaples of such uses are in the issuing of inventory tickets, and, the simultaneous development of an inventory stored in the memory of the microprocessor; as a portable device for use by sales persons in the issuing of sales receipts, again with a retained memory of the information stored in the memory of the device; the issuance of purchaser receipts at auctions; or, for any other such related purpose requiring mobility and portability of the ticket processing equipment.

A particularly advantageous use of the device is in the issuing of identification labels and the simultaneous development of an inventory of the articles so labeled at the source of their derivation and remote from their ultimate destination, such as genetic materials, biological or chemical specimens, geological or archeological materials and the like. Typical of such uses is the labeling at the source of specimens of bacterial, viral or fungal contaminents, tissue cultures, blood or other body fluids in the hospital, health care and food industries, and in the labeling at the source of terrestrial core samples, water samples and the like.

SUMMARY OF THE INVENTION

This invention provides an integrated device in which information can be made available to the user based upon data stored in a memory, and which in addition can print and dispense multiple part ticket sets electrically under the control of a computer actuated keyboard connected to a microprocessor, and, one which can be operated over extended periods of time, thus permitting ready use of the device in locations remote from the primary energy source, and, remote from the equipment employed in the subsequent processing of the stored information.

This is made possible by the use of a plurality of interrelated mechanisms which operate synergistically to produce a maximum conservation of the energy supply, including:

(1) A ticket construction which permits it ready translation through the device with a minimum of energy consumption and a maximum conservation of energy in the self-contained energy source.

(2) A storage device for the stacking of tickets, which permits extremely accurate positioning of each ticket of a stack and which ensures that ony a single ticket is fed into the device.

(3) A manually operated feeding device for initiating feeding of a single ticket into an indexing mechanism of the device under manual control from a stack of said tickets.

(4) An electrically operated printing head that is preferably energized during only one lateral direction of its travel, indexing of the ticket through the device by an electrically driven indexing mechanism being restricted to the duration of the return movement of the printing head, and being effected by the same drive motor as that employed for driving the printing head in its reciprocatory path of movement.

(5) A ticket indexing mechanism operable in conjunction and in sequence with the printing head by a single electrical motor common to the drives for both the printing head and the indexing mechanism, in order to eliminate the need for separate motors.

Referring briefly to each of the aforementioned aspects of the present invention, a novel ticket construction is preferably employed. In addition to the known use of overlying leaves of carbonless paper joined to a relative stiff substrate, preferably each leaf is of approximately the same size as the others and the respective leaves are either adhered along their entire lateral edges, or are spot bonded to each other at selected position along each of the lateral edges of the ticket.

The leaves thus form a unit which can be translated through the device without separation, creasing, or other distortions of the leaves of the ticket, such as could cause the printing on the respective copies to be misaligned relatiave to each other.

The adhesive is sufficiently strong to retain the super imposition and alignment of the leaves during processing, yet permits ready subsequent separation of the leaves without their destruction.

In this manner, the leaves act to reinforce the substrate, and in turn the substrate acts to stabilize the leaves. By minimizing the possibility of slippage of one leaf relative to the other or relataive to the substrate during the translation of the ticket through the device, there results an exact location of the printings of all of the copies as the ticket passes through the device.

Preferably, the respective leaves and the substrate are of a width closely equal to each other and to the substrate such that when stacked, the tickets are of relatively uniform thickness, particularly along their leading and side edges.

In order to provide for proper feeding of the tickets, it is arranged that the top leaf has its trailing edge spaced inwardly of the trailing edge of the substrate by a distance of eleven to twelve times the thickness of the top leaf, and that the trailing edge of the or each intermediate lead is spaced inwardly of the trailing edge of the substrate and intermediate that edge and the trailing edge of the top leaf such that the trailing edges of the respective leaves are arranged in stepped formation.

Each ticket of a stack of tickets is positionally aligned within a storage magazine of the device, such that the leading ticket is accurately positioned for in-feeding into an indexing mechanism of the device.

The storage magazine preferably includes a specially configured generally rectilinear chamber with at least one inclined end wall, such that the planar dimension along a platten or feed bed upon which a ticket is positioned for delivery is substantially equal to the planar dimension of that of the ticket, but is of a slightly lesser area than that provided for the other tickets of the stack.

In addition to being positionally oriented by the spring fingers, stack of tickets is gently urged towards the feed bed of the device by a resiliently loaded pressure plate mounted for omnidirectional movement within the storage magazine.

To insure the feeding of a single ticket only from the face of the stack of tickets, a rigid alignment plate is provided which terminates in a convex edge spaced from the feed bed or platten, and which provides an admission throat to the indexing mechanism. The spacing of the convex edge is by a distance slightly greater than the thickness of a single ticket and less than the thickenss of a pair of tickets. In this manner, it is assured that only a selected single ticket can be delivered to the indexing mechanism.

Significantly, the separation and the selective individual feeding into the indexing mechansim of the leading ticket from the face of the stack of tickets is accomplished manually, and, with the total elimination of engergy consumption from the energy source, by the use of a manual feed initiating device mechanically coupled to the electrically operated indexing mechanism.

A hand operable slide mechanism is employed having a handle exterior to the device and which can be gripped by a user of the device. The hand operable slide mechanism carries a rack engaged with an idler pinion coupled to a transporter for feed knives extending through the feed bed and which is operative to move the feed knives in a direction to move the leading ticket of the stack of tickets longitudinally into the indexing mechanism. The leading edge of the ticket passes under the concave edge of the alignment plate and becomes positioned between pinch and drive rollers of the indexing mechanism, which are at that time moved into spaced relationship with each other by camming members associated with the feed knife transport.

In order to preclude the possibility of multiple hand operations of the slide mechanism, and thus of the ticket feed knives, and interposer mechanism is associated with the hand operable slide mechanism. The interposer mechanism is released upon the terminating of a printing operation, and is reset by the hand operable slide mechanism on completion of its feed stroke, such that the hand operable slide mechanism can be operated only once at the initiation of a complete cycle of the device, and afterwards is positively locked against further operation unit termination of the completed cycle.

Conveniently, the pinion associated with the hand operable slide mechanism drives a rack attached to a member which carries the feed knives to provide for linear motion of the feed knives between their starting position and their feed position and return to their starting position. Also, conveniently, the feed knife transporter cooperates with a secondary reversible ratchet which inhibits reverse movement of the feed knife transporter until after the completion of a full tranverse of the feed knives in the feed direction, and, which inhibits reverse movement of the feed knives in the event that a full tranverse of the feed knives in the return direction has not been completed.

In this manner, the device becomes totally disabled in the event that the operator has not completed a full traverse of the hand operable slide mechanism in either the feed or the return direction, the option existing of re-operating the hand operated slide mechanism to complete either the feeding of a ticket, or, to complete the return stroke of the feed knives.

Upon return of the hand operable slide mechanism to its initial position, the camming members release the pinch rollers for them to engage and securely hold the ticket near its leading edge in readiness for indexing of the ticket through the device.

Immediately after the positioning of a ticket has been properly completed, and the feed knives have been returned to their initial position, the interposer associated with the hand operable slide mechanism re-sets. This blocks subsequent actuation of the hand operated slide mechanism until after the completion of a total printing and dispensing operation by the device.

A sensing device, such as a micro-switch which closes or opens in response to the presence of absence of a ticket within the magazine, prevents operation of the hand operable slide mechanism when the magazine is empty.

Once the ticket has been fed into its initiating position in the indexing mechanism, the entire device is then set for the entry of data into the microprocessor. Alternatively, the data can be entered into the microprocessor prior to the feeding of a ticket, such that, immediately upon entry of the ticket into its initiating position in the indexing mechanism, the entire printing of the ticket dispensing of the printed ticket proceeds on an automated basis.

The movement of the printing head and the indexing of the ticket preferably, is effected by a single electric motor common to both mechanisms.

To further reduce energy losses in these mechanisms, the respective mechanisms are driven through the intermediary of a scroll cam, which is operative to reciprocate the printing head laterally in both directions relative to the ticket. The indexing mechanism for the ticket is enabled and disabled by a Geneva movement driven from the scroll can under the control of a second interposer. Preferably, the respective motions are controlled in sequence by a pulse generator driven by the electric motor, the pulse generator conveniently including a slotted wheel attached to the motor shaft, and which cooperates with a magnetic pulse generator in order to further conserve energy.

Once the printing of the ticket has been completed, it exits from the driving roller station and can then be manually withdrawn from the device by gripping its protruding end and pulling it out of the device.

After completion of a full term of service, the device is then connected to the input port of a computer at a base station, and, information stored in the memory of the microprocessor is transferred into the memory of the main computer. Should the drain on the energy source have been so heavy that there is insufficient residual energy in the energy source for it to operate the device, more particularly, the printing and indexing mechanisms, the microprocessor automatically disables the device to conserve the remaining energy and insure that the information stored in the memory of the microprocessor is not erased. Full services of the device are restored once the energy source has been recharged at the base station. Preferably, the operator actuated keyboard is electronic, the respective keys on the keyboard being in the form of manually operable switches, the read-out of the keyboard being a display comprised of a vacuum flourescent module, light emitting diodes, or, a liquid crystal display, each of which are well known in the art.

DESCRIPTION OF THE DRAWINGS

The invention will now be described with reference to the accompanying drawings, which are illustrative of a preferred embodiment of the invention and, in which:

FIGS. 5 and 6 are enlarged details of the construction of FIG. 4;

FIG. 7A illustrates a preferred form of energy conserving interposer for use in the device of the present invention;

FIGS. 9 through 12 illustrate diagrammatically the manner in which a ticket feeding carriage is blocked from reverse movement until such time as the entire movement of the carriage in one direction or the other has been completed;

DESCRIPTION OF THE PREFERRED EMBODIMENT

Figure 1:
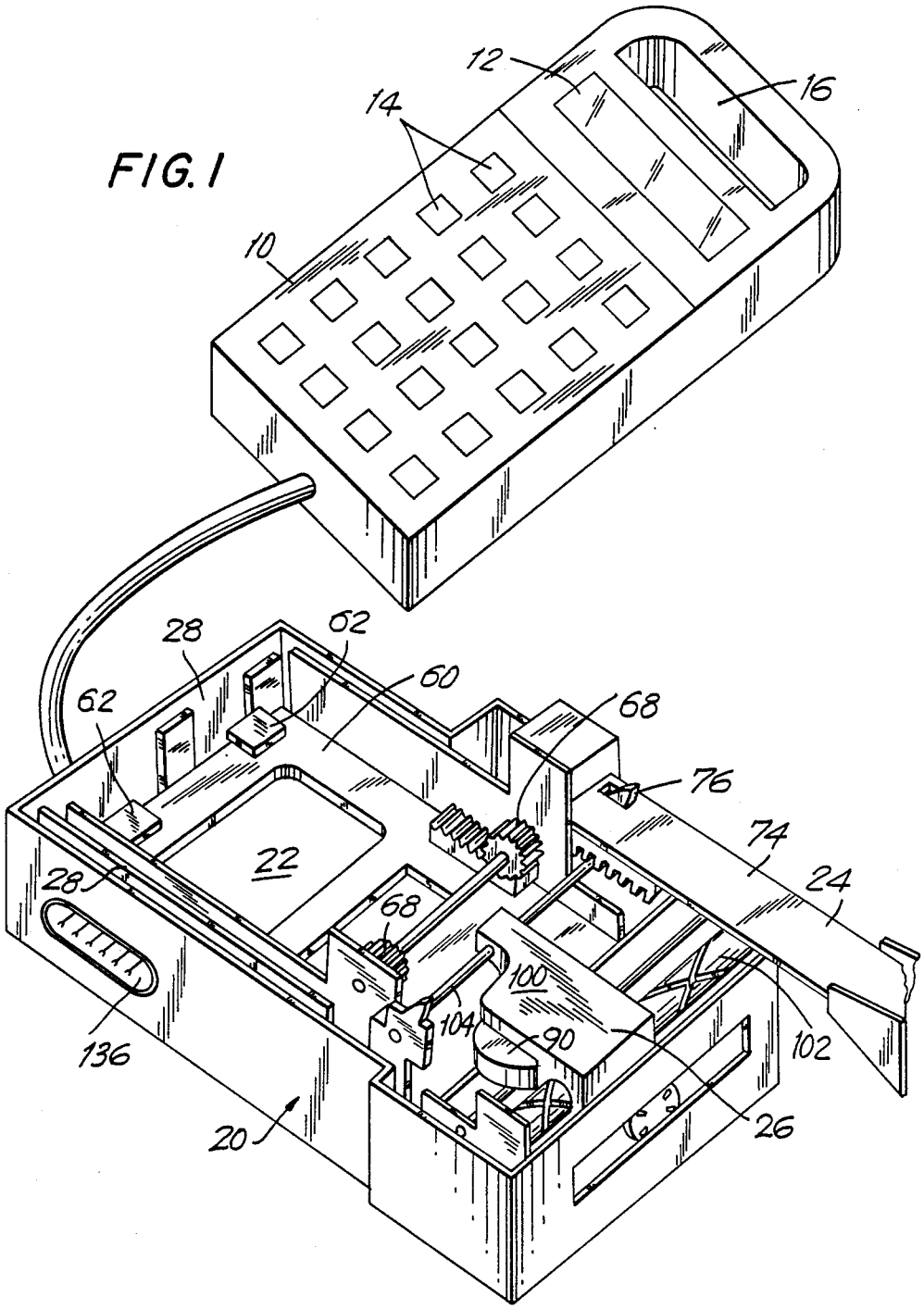
FIG. 1 is a perspective view illustrating the general organization of the device of the present invention.

Referring now to FIG. 1, the device of the present invention is shown as a two-part unit incorporating a manually operable keyboard 10 having a display 12 and keys 14, as appropriate to its intended function. Conveniently, the keyboard 10 can be provided with a handle 16 for convenience in the carrying of the keyboard.

While the keybaord is shown as a unit separate from the main body of the device of the present invention, and connected thereto by an umbilical cable, the keyboard equally well could be incorporated into the cover of the device, such that the entire device is a unitary one.

The main portion of the device is indicated 20, and includes a ticket storage and dispensing magazine, which, in FIG. 1 is positioned on the underside of the device, and is indicated generally at 22; a manually actuable feeding device for translating a ticket from the face of a stack of tickets contained within the magazine into initiating position within the device, the manually actuable mechanism being indicated generally at 24; a laterally moveable printing head, indicated generally at 26; a mechanism for indexing a ticket longitudinally past the printing head 26, and which lies immediately beneath the printing head 26 and it thus obscured from view in FIG. 1; electronic circuit boards indicated generally at 28, and, an energy source (not shown in the form of a battery pack of rechargeable batteries, which conveniently is positioned in the space overlying the storage magazine 22.

Figure 2:
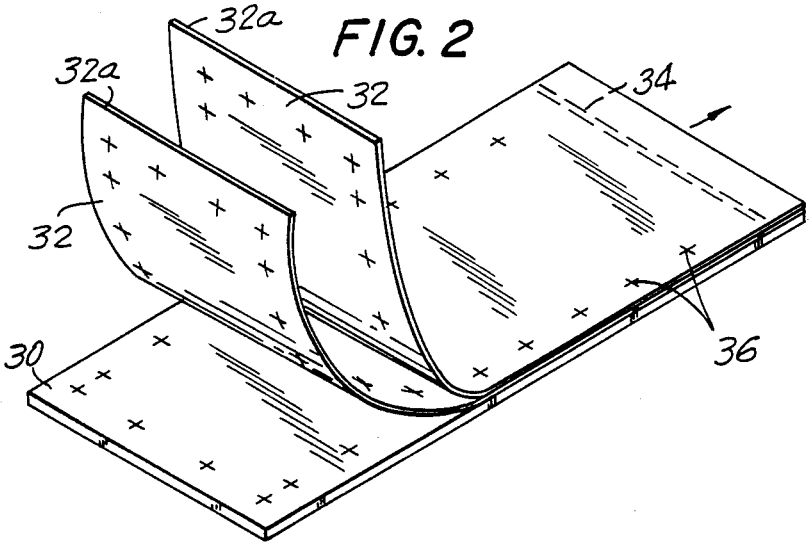
FIGS. 2 and 2*a* are perspective views of a ticket specifically intended for use in the device of the present invention.
Figure 2A:
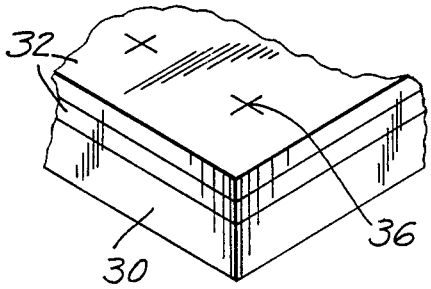

The ticket which is preferably employed in the device, illustrated in FIGS. 2 and 2A of the drawings.

In FIG. 2, as is conventional, the ticket comprises a substrate 30 of paperboard material of sufficient strength and rigidity to resist buckling when subjected to axial loading by the picker knives, and to maintain it substrate 30 are one or more leaves 32 of a relatively thin paper preferably carbonless paper, incorporating ink that it released upon applying pressure to the paper. Further, as is well known in the art, the respective paper layers 32 are connected to the substrate, such as by adhesive as indicated at 34.

For use in certain applications, one or more of the leaves can be coated on their rear face with a wettable or self adhesive to provide tear off or peel off labels for attachment to an article or container to be identified and inventoried at its source of derivation.

In accordance with one aspect of the present invention the respective leaves 32 are attached to each other or to the substrate 30 at spaced positions along the perimeter of the substrate 30, as is indicated at 36 in FIG. 2.

The interconnections can be effected in any convenient manner, such as by applying gum to the substrate and to the leaves at the said spaced positions, or, by ultrasonic welding, or, any other convenient technique that does not result in destruction of the planar form of the ticket, but which readily permits separation of the leaves one of the other without destroying their integrity. Further, the interconnections of the respective leaves 32 and the substrate 30 are conveniently at spaced positions 36.

The adhesion of the rspective leaves of the ticket to the substrate provides multiple advantages. Firstly, by tacking the relatively flimsy leaves 32 to each other and to the substrate 30, the leaves are at all times maintained closely parallel to the substrate 30. Also, the leaves when tacked to the substrate, further increased the stability of the substrate as a planar lamina. Further, the respective leaves are secured against displacement in the longitudinal direction relative to the substrate, such as would otherwise occur during the translation of the ticket through the device, with consequential misalignment of the respective printings, or, ruckling or crinkling of the leaves. In the absence of securement of the respective leaves to each other and to the substrate, there is a tendancy for the leaves to lag behind the substrate, with consequential misalignment of the printings. This is due to the frictional drag imposed on the leaves, and due to the frictional driving of the substrate at its exposed lower surface by the elastomeric drive rollers. Any slippage of the leaves relative to the substrate would, if permitted, cause bowing of the substrate in the longitudinal direction and tensioning of the leaves in that direction, with possible tearing of the leaves and their separation from the substrate. There is also a far lesser possibility of one of the relatively flimsy leaves 32 tearing and becoming jammed within the respective mechanisms, which could result in total disablement of the device until such time as it was properly serviced.

Further, and as is illustrated in FIG. 2*a*, while the bottom edges 32*a* of the respective leaves 32 are positioned in general superimposition, they are positioned in a closely determined stepped relationship in which the top leaf has its trailing edge spaced forwardly of the trailing edge of the substrate 30 by a distance of eleven to twelve times the thickness of the top leaf. The intermediate leaf has its trailing edge spaced from the trailing edges of the top leaf and the substrate.

The stack of the tickets of FIG. 2, will not only be as flat and therefore as thin as is practicable to permit the storage of as great a number of tickets as is possible, but also, the ticket presents the equivalent of stabilizing reinforcements along its side and trailing edges.

Figure 4:
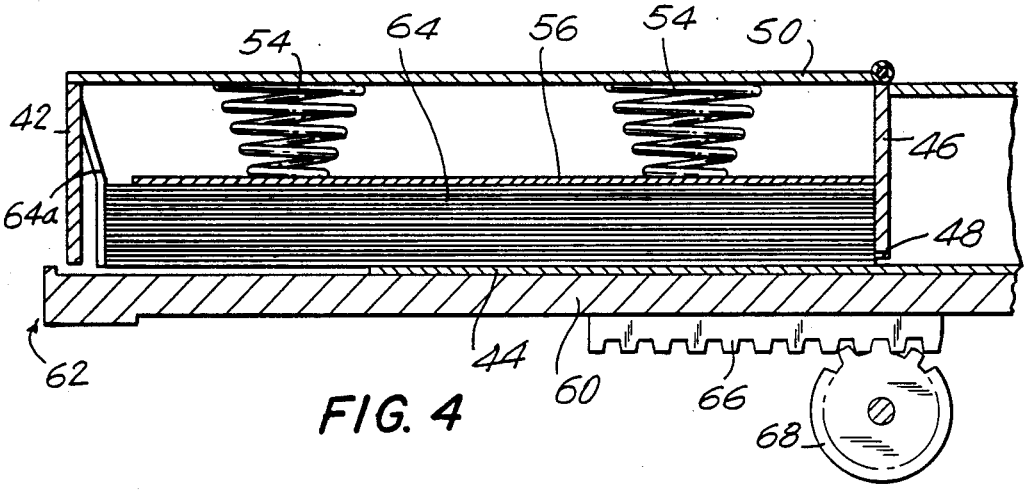
FIG. 4 is a diagrammatic longitudinal cross-section through ticket feed knives included in the magazine of FIG. 3.
Figure 3:
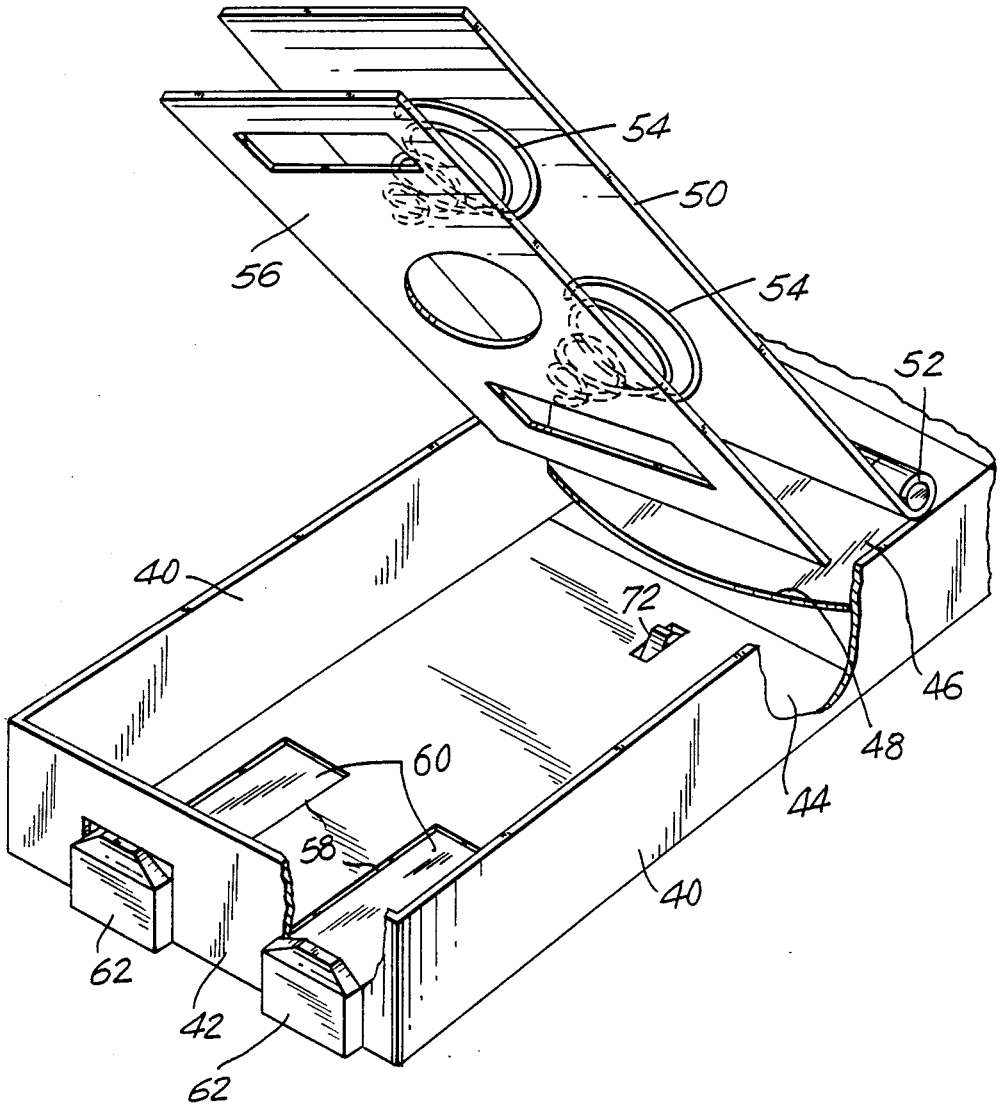
FIG. 3 is a perspective view of a magazine for storage and sequential dispensing of tickets from a stack of such tickets.

In FIGS. 3 and 4, the magazine is shown in the position it occupies after the inversion or turning over onto its face of the device 20 of FIG. 1, i.e., the magazine is illustrated as viewed from the underface of the device 20 as illsutrated in FIG. 1.

The magazine is contructed for it to cooperate with tickets in a manner which minimizes frictional restraint on a ticket as it is translated through the device, and, when assures accurate alignment of a face ticket of a stack of such tickets with the respective feed mechanisms.

In FIG. 3, the magazine is comprised of a relatively shallow tray incorporated into the body of the device 20 of FIG. 1, the tray having fixed side walls 40, a fixed end wall 42, and a fixed platen 44 comprising the bottom wall of the tray.

The opposite end wall of the tray is comprised by a rigid alignment plate 46 having a smooth and relatively friction free surface, and, which terminates at its lower edge adjacent the platen in a convexly curved edge 48.

The top of the tray is closed by an access door 50, which is hinged at 52 in any convenient manner to the lower face of the device 20, and which carries helical springs 54 on its under face. The helical springs 54, in turn, are connected to a pressure plate 56 at points spaced along the median line of the pressure plate 56, such that the pressure plate 56 is supported for omnidirectional movement relative to the helical springs 54, and in self-alignment and continuous face engagement with a stack of tickets positioned within the storage tray.

Extending into the storage tray through slots 58 in the platen 44 are legs of a carriage or transporter 60 each carrying a feed knife 62. The underside of the carriage 60 and the feed knife 62 is more clearly illustrated in FIG. 1.

The feed knives 62 are formed with convex edges, again for the purpose of minimizing unwanted markings on the tickets, particularly on the return stroke of the knives. As will be readily apparent, upon opening of the closure plate 50, a stack of tickets such as the ones illustrated in FIG. 2 can be inserted into the magazine. In use of the device, the substrate will face up and the leaves will face down, such a stack of tickets being indicated at 64 in FIG. 4, the stack of tickets being lightly compressed against the platen 44 by the action of the pressure plate 56 and the helical springs 54. To insure accurate alignment of the tickets within the device, the tickets are urged at their leading edges into abutting contact with the alignment plate 46, leaf springs 64*a* being provided adjacent the end wall 42 for so urging the tickets of the stack. Alternatively, and in order to create a more closely fitting receptacle for the ticket to be delivered, thus aiding its alignment for feed, the end wall 42 can be inclined, or provided with members which intrude into the compartment and are appropriately inclined, the members are optionally the end wall itself preferably being formed from a material having a low coefficient of friction.

To initiate the feeding of a ticket, the carriage 60 carrying the feed knives 62 is moved longitudinally within the device. This motion is produced by a rack 66 moved by a rotatable pinion 68, the direction of movement of the feed knives 62 in FIG. 4 being towards the right-hand side of FIG. 4.

To indicate the absence of tickets in the storage magazine, a microswitch 70 is provided mounted on the underside of the platen 44. The microswitch 70 is operated by a spring finger 72 positioned in alignment with an aperture 56*a* in the pressure plate 56, as is shown in FIG. 3. In the presence of a supply of tickets within the magazine, as illustrated in FIG. 6, the spring finger 72 is held depressed, in turn closing the microswitch 70 and enabling the electronic circuitry 28 of the device. The spring finger 72 is released in the absence of tickets in the magazine.

Referring now more particularly to FIG. 6, upon rightward movment of the feed knives 62, the ticket to be fed from the stack of tickets 64 is engaged at its bottom edge by the feed knives 62. The knives have a projecting height equal to or slightly less than the thickness of a single ticket in order that the knives engage only the relatively stiff substrate 30. The central region of the alignment plate 46 is so positioned relative to the platen 44, that a throat is provided through which but a single ticket can pass, the spacing between the central region of the plate 46 and the platen 44 being only slightly larger than the thickness of a single ticket and less than the thickness of two tickets.

Figure 7:
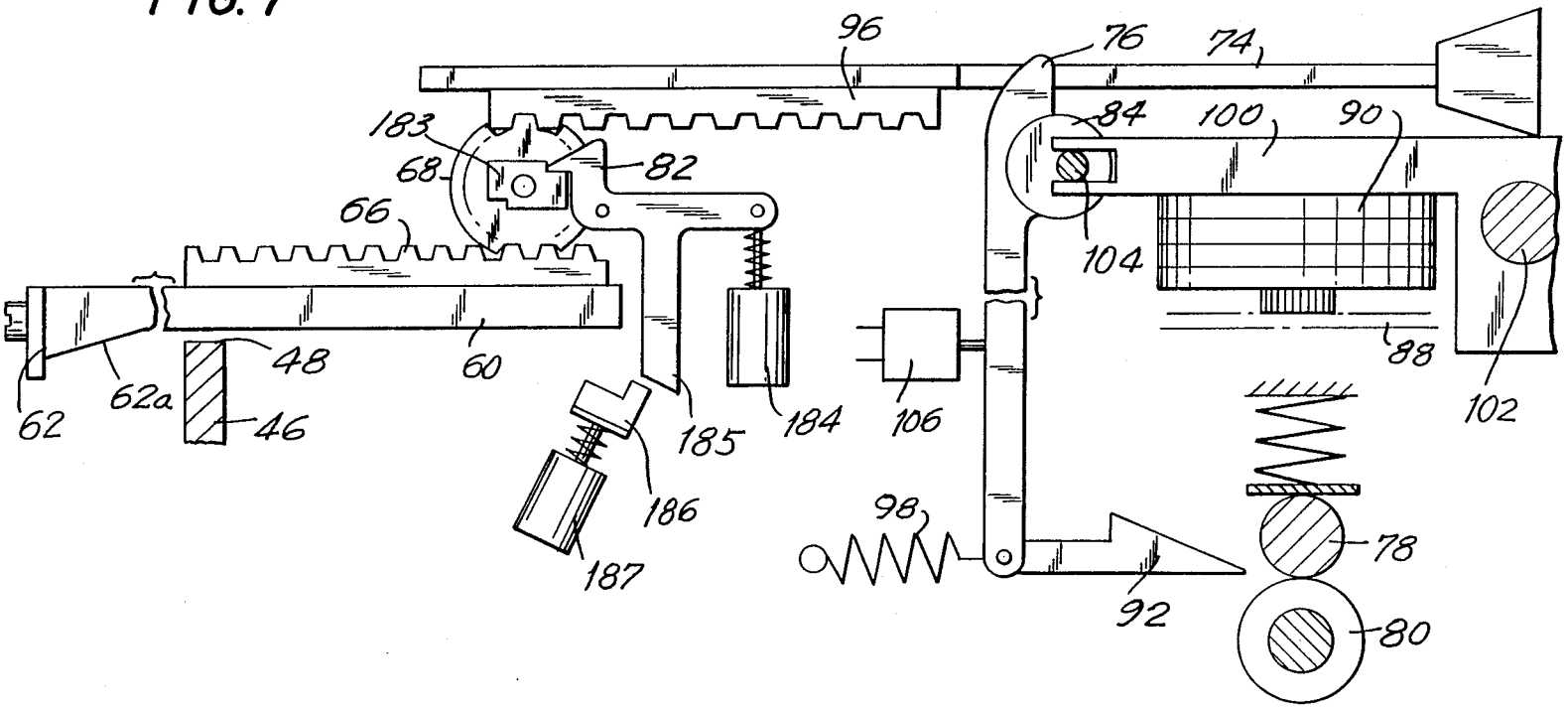
FIGS. 7 and 8 are diagrammatic illustrations of the manner in which a ticket is fed from the magazine and into initiating position with the device.

Referring now to FIG. 7, the feed knives 62, the alignment plate 46, the carriage or transporter 60, the rack 66, and the pinion 68 are each shown in the position they occupy as related to FIG. 1 of the drawings.

In FIGS. 1 and 7, carriage or transporter 60 is shown in its position prior to the initiation of the feeding of a ticket. At this time, a manually operable slide 74 of the manually operable mechanism 24 is in a position in which it extends outwardly of the housing of the device to a maximum extent, the slide 74 being locked in that position by an electrically operated interposer device 82, associated with the shaft of the pinions 68.

The interposer 82 can be of any convenient form. In the illustrated embodiment of FIG. 7 the interposer 82 is engaged with a block 183 fast with the shaft of the pinions 68, and can be withdrawn against the spring bias by a solenoid 184. Solenoid 184 moves a latch 185 of the nterposer into engagement with a spring biased retainer 186, wher it remains locked until a second solenoid 187 is energized. The spring bias of the solenoid 184 then moves the interposer into the shown engaged position. In this manner, the interposer can be actuated by momentary energization of either the solenoid 184 or 187, without the requirement for maintaining either one of the solenoids energized, this resulting in a very substantial conservation of the energy of the energy source of the device.

The same operative arrangement is shown in a preferred form in FIG. 7A, in which the respective elements of the combination can be arranged substantially in a planar formation. In FIG. 7A, the same reference numerals have beeen used as those used in FIG. 7 to indicate corresponding parts.

FIG. 7A shows the interposer when the enabled state in which the latch 185 is held by the spring biased retainer 186. Upon temporary energization of the soleniod 187, the latch 185 is released by retainer 186, this causing the interposer 82 to move into blocking engagement with a block 183 fast with the shaft **68*a* under the influence of the spring of the solenoid 184. Shaft 68*a* supports the pinions 68, and is rotatable in unison therewith. To release the interposer, solenoid 184 is temporaily energized, this causing the interposer 82 to reset and its latch 185 again to become held by the retainer 186. This arrangement permits the interposer mechanism to be positioned within the otherwise unused space on top of the platten 44**.

FIG. 7 shows the mechanism in the position it occupies immediately after the feeding of a ticket between pressure rollers 78 and power driven feed rollers 80, the mechanism at this time being locked against further actuation by the electrically operated interposer device 82. The interposer itself consumes no electrical energy other than that required to move the stop member between its locking and release positions. The use of an interposer is particularly advantageous since it involves a minimum of energy usage.

In FIG. 7, a ticket 88 is shown positioned beneath a printing head 90, and in the position it occupies when trapped between the pinch of the rollers 78 and 80. For clarity of illustration, in FIG. 7 and 8 the rollers 78 and 80 and the mechanisms associated therewith are shown displaced downardly from the plane of the ticket 88.

The printing of the ticket proceeds under electrical actuation and lateral traversal of the printing head 90, accompained by longitudinal indexing of the ticket by means of intermittant rotation of the drive roller 80, also under the control of the microprocessor.

During a printing operation the manually operable feed device is disabled. Otherwise, a further ticket could be fed from the magazine prior to the removal of the ticket already positioned within the device, and with consequential jamming of the entire device.

At the termination of the printing and dispensing of the ticket within the device, the interpose 82 is moved to its unlocked position so as to enable rotation of the shaft carrying the pinions 68.

Figure 8:
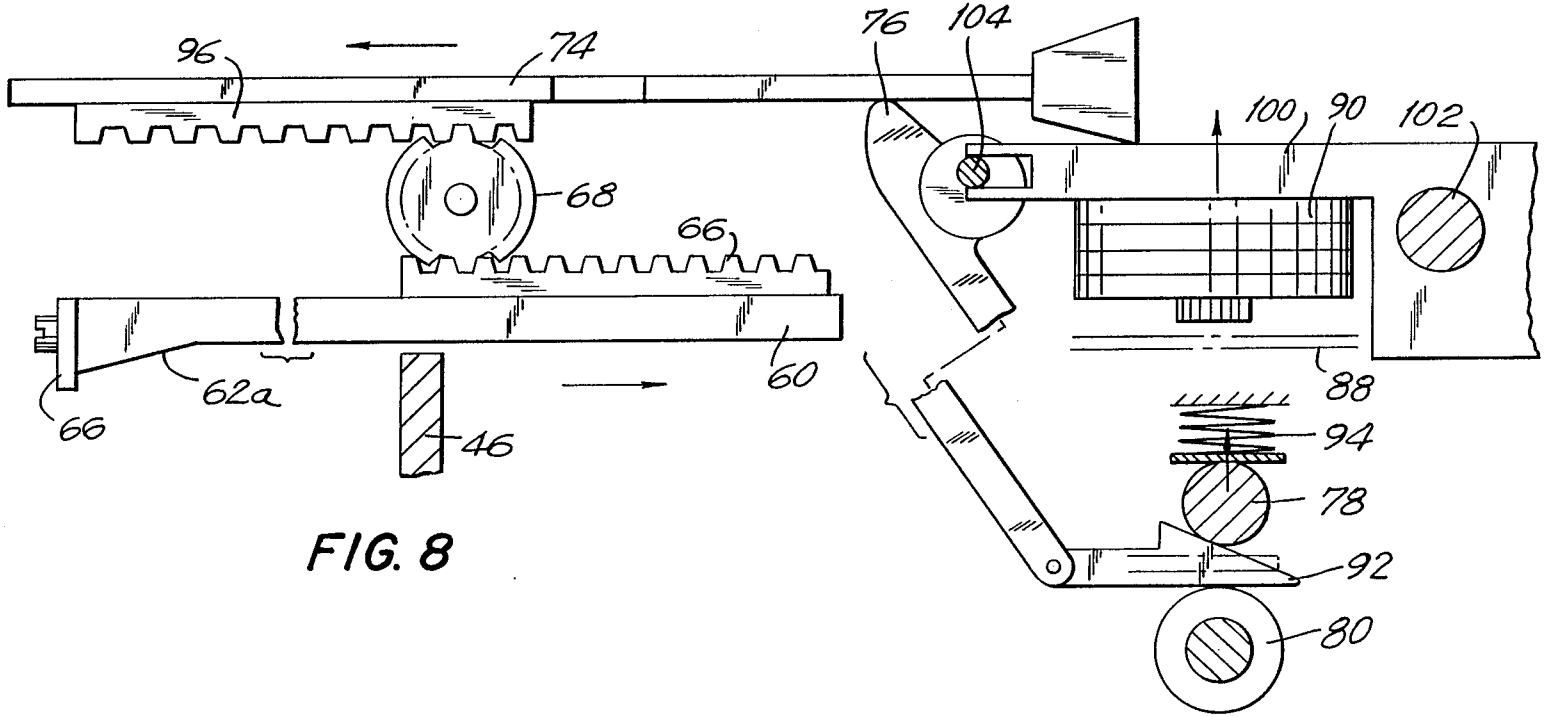

Referring now to FIG. 8, unlocking of the interposer 82 permits the manually operable slide 74 to move to the left, and in turn cause a cam 76 to rotate about its journal 84, and then to lie beneath the slide 74. The pawl is moved to that position by virtue of longitudinal movement of the manually operable slide 74, which, in FIG. 8 is a leftward direction. This leftward movement causes the cam 76 to rotate counterclockwise about its journal 84, and, in turn, to force a ramp cam 92 into interposition between axles of the pinch rollers 78 and drive rollers 80, to force the rollers away from each other against the bias of a spring 94.

After rotation of the cam 76 to its displaced position, the slide 74 continues its leftward movement, this causing a rack 96 fast therewith to rotate the pinions 68, and in turn, to drive the carriage 60 in an opposite direction. The feed knives pick the trailing edge of the next ticket of the stack, this causing transport of the ticket to a position between rollers 78 and 80 in preparation for its incremental feeding.

At the time the feed knives move to engage the substrate 30, a slight compression is produced in the rearmost portion of the stack by the corresponding movement of a ramp **62*a* adjacent the knives and integral with the carriage 60. This assists in the proper engagement of the knives with the substrate 30**.

Simultaneously with the movement of the cam 76 and the ramp cam 92, a carriage 100 on which the printing head 90 is mounted is moved upwardly about a journal 102 by means of a rod 104 mounted eccentrically on the journal 84, the rod 104 and the carriage 100 being illustrated in FIG. 1, as is the journal 102. In this manner, the printing head is moved upwardly out of the path of the entering ticket as the ticket moves to the drive and pinch roller station.

The slide 74 is then returned to its position as shown in FIG. 7, thus returning the carriage 60 to its initial position shown in FIG. 7, and, permitting re-setting of the cam 76 under the influence of a spring 98. In returning to its re-set position, the cam 76 rotates about the journal 84, and, the ramp cam 92 is withdrawn from the pinch of the rollers 78 and 80, thus permitting the rollers to clamp onto the ticket near its leading edge, thus readying the device for the next printing and dispensing operation.

Also, the printing head is lowered into printing relationship with the ticket, the ticket then having beeen properly positioned within the pinch of the rollers 78, 80 and held therein.

Upon return of the manually operable feed mechanism to the starting position of FIG. 7, the drive rollers are engaged for feeding, and the print head has been lowered to the print position.

A block mechanism is provided as illustrated in FIGS. 9 through 12, to insure completion of a full stroke of the manually operable slide, in either of its directions, before enabling a reverse movement. In FIGS. 9 through 12, a secondary rack 106 is positioned on the carriage 60, the secondary rack 106 coacting with a pivotally mounted pawl 108. The pawl 108 is pivotable on a shaft 110, and is loaded by a spring 112 for it to occupy the position shown in FIG. 9. Upon rightward movement of the carriage 60 is shown in FIG. 10, the pawl 108 will then swing in a counterclockwise direction, and, will ride over the teeth of the rack while permitting free movement to the right of the carriage 60. If any attempt is made to move the carriage 60 to the left prior to the completion of its full extent of movement, the pawl 108 will then engage with the rack, and prevent any such reverse movement. Eventually, the rack will reach the position shown in FIG. 11, and the pawl 108 will assume its original position. Return movement of the carriage 60 is at that time enabled, the pawl 108 then swinging clockwise to an opposite angle of inclination relative to the rack 106, and permitting free movement of the carriage 60 in a leftward direction, but preventing any movement in a reverse direction until such time as the rack reaches its initial position as illustrated in FIG. 9.

Figure 13:
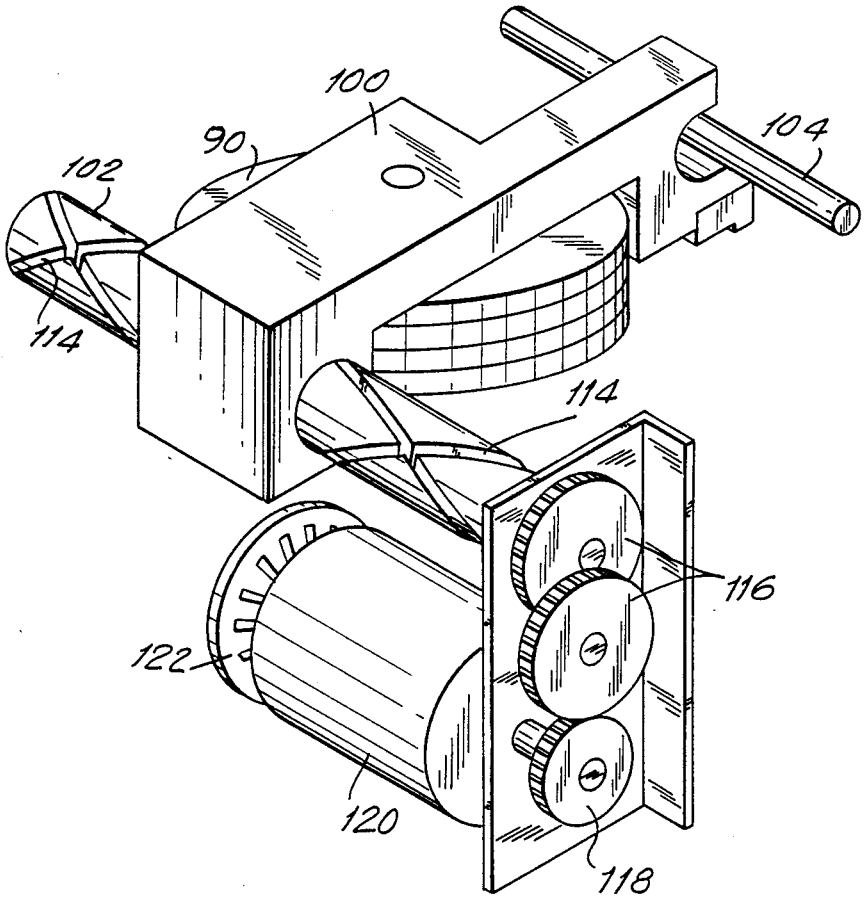
FIG. 13 is a fragmentary perspective view of a mechanism for indexing the printing head laterally of the ticket, and is a view taken from the right-hand side of FIG. 1.

Referring now more particularly to FIG. 1 and 13, there is illustrated the manner is which the printing head 90 is indexed transversely of the device, in order that successive indicia may be printed by the printing head 90.

As previously stated, the carraige 100 for the printing head 90 is angularly movable about the journal 102 under the control of the eccentrically mounted rod 104, this being for the purpose of raising the printing head during the entrance of a ticket to be printed, after which the rod 104 and thus the carriage 100 is returned to the printing position.

To provide for indexing of the carriage 100 laterally of the device, the journal 102 is formed as a double scroll cam, the surface of the journal 102 being provided with continuous interconnected grooves 114 extending circumferentially and longitudinally of the journal 102.

The grooves 114 receive a driving cam contained within the carriage 100, such that when the journal 102 is rotated, the carriage 100 is first moved from left to right laterally of the device, and is then returned from right to left, this oscillating movement of the carriage being continuous as long as the journal 102 is rotated.

In order to provide for rotation of the journal 102, appropriate reduction gears 116 provide a gear train between a driven pinion 118 and a pinion 116 fast with the journal 102. The pinion 118 is driven by an electrical motor 120, the motor 120 being provided with a count wheel 122 mounted on an oppositely extending end of its rotor shaft.

The count wheel 122 is employed to provide information as to the position of the printing head at any particular time, the count wheel being associated with an optical pulse pickup device (not shown) such as is commonly known in the art.

Thus, by this construction, the printing head 90 can be moved laterally of the printed ticket, and its operation synchronized with information provided by a microprocessor under the control of the information supplied by the count wheel.

Figure 14:
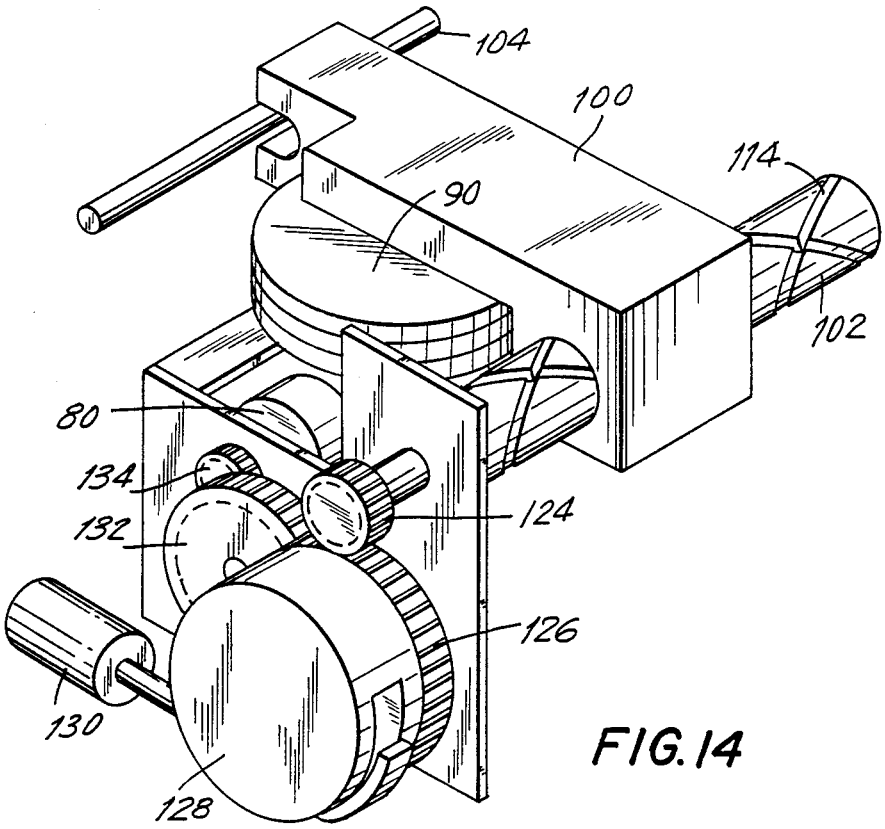
FIG. 14 is a fragmentary perspective view of mechanism for indexing a ticket through the device, the view being taken from the left-hand side of FIG. 1.

Referring now to FIG. 14, there is illustrated the manner in which this movement of the printing head 90 is synchronized with indexing of the ticket through the device. As illustrated in FIG. 14, the driven journal shaft 102 drives an idler pinion 126 of an intermittant drive unit 128.

During movement of the printing head from right to left of the device, the intermittent drive unit 128 is disabled, and, the idler pinion 126 free wheels, At the time the printing head 90 reaches its extreme position of leftward movement, a further interposer 130 enables the intermittent drive unit 128 to rotate once to provide a drive via pinions 132, 134 to the shaft of the drive roller 80. The gear ratios of the pinions 124, 126, 132 and 134 are such that the ticket is driven by the drive roller 80 and is indexed forwardly by the distance of one line of printing as the printing head 90 returns to its starting position at the right hand side of the device.

The gears cooperate as a Geneva mechanism to lock the gear train against casual movement after the required rotation has been completed. Thus, the ticket can not be moved manually by pulling it out of the device, and can only be moved by a succeeding actuating command via interposer 130.

Figure 15:
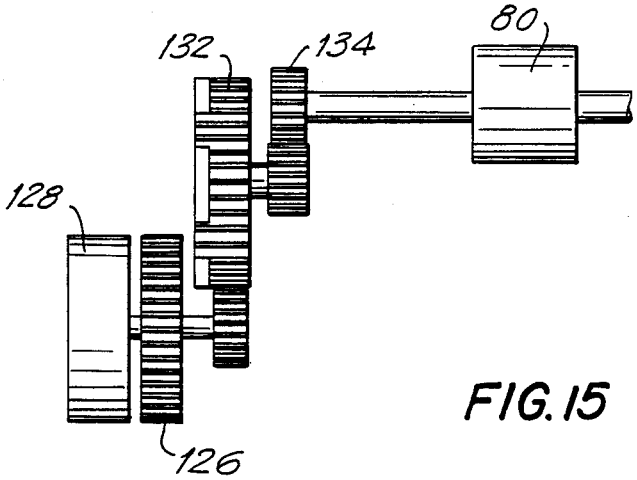
FIG. 15 is a detail of a Geneva type movement incorporated into the indexing mechanism of FIG. 14.

FIG. 15 illustrates in greater detail the Geneva movement of FIG. 14, the same reference numerals having been used to indicate corresponding parts.

Having reached the right hand side of the device, the microprocessor, on the basis of information provided by a flag (not shown) mounted on carriage 100 having entered an optical encoder (not shown) establishes that "Home" position has been reached, from which the next line to be printed will originate.

By integrating the drive to the carriage 100 of the printing head and the intermittent drive to the drive roller 80, a considerable reduction in the energy consumption of the device is obtained, as compared with the use of separate electrical motors for driving the respective journal 102 and the drive rollers 80.

In use of the device, the device will be powered by means of an energy source contained within the device, and which, conveniently can be positioned in the free-space overlying the carriage 60. The energy source contemplated is that of a battery of recharageable nickel cadmium cells, which preferably are assembled into a single self-contained unit, and connected to pins of a computer outlet port 136, such that the cells can be reacharged while they are in situ, without the necessity of removing the battery pack from the device. This, of course also permits the device of the invention to be used in the alternative in a fixed location, without regard to its length of service.

Either before or after a ticket has been moved by the manually operable mechanism into its intiating position between the drive and pinch rollers, the user can enter any required information by use of the keyboad, that information then being used to control the printer, the information remaining stored within the memory of the device. After completion of a tour of duty, the device will be connected to the inlet port of a computer, and, the informatin stored in the memory of the device transferred into the computer memory and erased or modified from the memory of the device. The device can then be connected by an appropriate umbilical cord for overnight recharging of the contained battery pack, and, is then readied for an extended tour of duty on the following day.

It will be appreciated that various modifications may be made of the preferred embodiment described above, without departing from the scope of the appended claims, the preferred embodiment having been described by way of example only.

We claim:

1. A device for use in printing and dispensing tickets, such as traffic or parking violations tickets, comprising in combination:

a storage magazine for containing a stack of said tickets, said storage magazines including:

opposed sidewalls;

an endwall;

an alignment plate providing an opposite end wall;

a bottom wall providing a platen; and a resiliently loaded pressure plate providing a closure for said magazine;

said alignment plate terminating adjacent said platen in a convex edge spaced from said platen by a distance closely approximating the thickness of a single one of said tickets and thus providing a throat that will permit the passage of only a single ticket therethrough, and which will inhibit the passage of more than one ticket therethrough;

a manually operable slide mechanism for removing one ticket at a time from said stack of tickets and for transferring that ticket under manual energy and in the absence of electrical power into a printing and indexing mechanism;

said manually operable slide mechanism including a carriage member mounted for linear sliding movement between said platen; feedknives carried by said carriage and extending into said magazine through linear slots in said platen; and, drive means for moving said carriage member linearly for said feedknives to engage an adjacent lateral edge of a single said ticket at the face of a stack of said tickets, and to move said single ticket in a linear manner through said throat and into said printing and indexing mechanism;

said printing and indexing mechanism being electrically driven from a drive mechanism common to both the printing and indexing mechanisms, and including:

an electriclly actuated dot matrix printing head and a mechanical drive mechanism for traversing said printing head along a linear path extending transversely of a said ticket from a first and starting position to a second and terminating position and then returning said printing head to said first and starting position under the control of said electrically driven mechanism, and a driving connection from said mechanical drive mechanism to said indexing mechanism which is enabled only during a return movement of said printing head from said second and terminating position to said first and starting position, said printing head being operated only during movement from said first and starting position to said second and terminating position, said drive to the indexing mechanism being operative upon termination of a printing operation of said printing head;

whereby, said printing head and said indexing mechanism are operated in sequence one with the other from said electrically driven mechanism.

2. The device according to claim 1, further including resilient members associated with said end wall, and for engagement with adjacent lateral edges of a stack of said tickets, said resilient members being operative to urge said respective tickets into engagement with said alignment plate.

3. The device according to claim 1, including a resiliently biased member extending through said platen, and operative to engage and sense the presence of a ticket positioned on the said platen.

4. The device according to claim 1, in which said drive means for moving said carriage includes:

a first linear rack mounted on said carriage;

a pinion engaged with said first linear rack;

a manually operable slide supported in said device for linear movement parallel to and opposite direction of linear movement of said carriage; and a second linear rack carried by said manually operable slide and engaged with said pinion at a position diammetrically opposite the engagement of said first rack with said pinion.

5. The device according to claim 4, further including a locking mechanism for said manually operable slide, said locking mechanism including:

a cam receivable within an aperture in said manually operable slide;

a journal supporting said locking cam for angular movement about an axis transverse to the direction of movement of said manually operable slide;

an extension of said cam extending to an opposite side of said axis; and, a ramp cam connected to said extension by a linkage, and which is movable against a resilient bias by said extension upon release of said electrically operated locking member and manual actuation of said manually operable slide;

the interaction of said manually operable slide and said cam providing the required motive power to move said extension against said bias upon manual actuation of said manually operable slide;

said ramp cam being positioned for it to be interposed between the axes of resiliently loaded drive and pinch rollers when moved by said extension, in order to permit the insertion between said rollers of the leading edge of a said ticket as it is moved into said printing and indexing mechanism.

6. The device according to claim 5, further including:

a rod carried by said journal and mounted eccentrically of the axis thereof;

whereby said rod is raised upon movement of said pawl, said rod being associated with a printing head and being operative to raise said printing head away from the path of movement of a ticket during insertion of said ticket into the pinch of said pinch rollers.

7. The device according to claim 6, in which said printing head is mounted on a carriage supported on a journal for angular movement about the axis of said journal, and, said carriage is movable axially along said journal between opposite extreme positions, to permit traverse of said printing head laterally of said ticket.

8. The device according to claim 7, including:

an electrically powered drive motor for rotating said journal about its longitudinal axis;

a scroll cam track formed in the outer peripheral surface of said journal and extending axially thereof; and, a cam follower fast with said printing carriage and engaged with said scroll cam for reciprocating said printing carriage axially of said journal upon rotation of said journal.

9. The device according to claim 8, including an intermittant drive driven by said journal, and which is operative to rotate said pinch rollers by fixed increments upon activation of said intermittant drive, whereby to index a ticket past said printing head in increments of one line of printing on said ticket.

* * * * *